US005614892A

United States Patent [19]

Ward, II et al.

[11] Patent Number: 5,614,892

[45] Date of Patent: Mar. 25, 1997

[54] PAYMENT SLOT COMMUNICATING APPARATUS FOR VENDNG PRICES

[75] Inventors: Seth Ward, II; Gary W. Speas, both of Little Rock; R. Todd Brown, Russellville, all of Ark.

[73] Assignee: POM, Inc., Russellville, Ark.

[21] Appl. No.: 427,603

[22] Filed: Apr. 24, 1995

[51] Int. Cl.[6] ..... G08B 23/00; G08C 15/06

[52] U.S. Cl. ..... 340/870.02; 340/825.02; 340/932.2

[58] Field of Search ..... 340/825.54, 870.02, 340/825.31, 825.35, 932.2; 194/217

[56] References Cited

U.S. PATENT DOCUMENTS

| | | | |
|---|---|---|---|
| 4,356,903 | 11/1982 | Lemelson et al. | 194/1 R |
| 4,379,334 | 4/1983 | Fragins, Jr. et al. | 364/467 |
| 4,423,319 | 12/1983 | Jacobsen | 235/472 |
| 4,611,205 | 9/1986 | Eglise | 194/217 |
| 4,823,928 | 4/1989 | Speas | 194/217 |
| 4,845,484 | 7/1989 | Ellsberg | 340/825.35 |
| 4,967,895 | 11/1990 | Speas | 194/200 |
| 4,985,921 | 1/1991 | Schwartz | 380/24 |
| 5,140,317 | 8/1992 | Hyatt, Jr. et al. | 340/825.31 |
| 5,155,614 | 10/1992 | Carmen et al. | 359/189 |
| 5,166,680 | 11/1992 | Ganot | 340/932.2 |
| 5,337,253 | 8/1994 | Berkovsky et al. | 194/217 |
| 5,376,930 | 12/1994 | Merkle et al. | 340/825.54 |
| 5,386,362 | 1/1995 | Keret | 340/825.35 |
| 5,434,399 | 7/1995 | Barbe | 235/382 |

FOREIGN PATENT DOCUMENTS 2077475 12/1981 United Kingdom .

*Primary Examiner*—Jeffery Hofsass
*Assistant Examiner*—Timothy Edwards, Jr.
*Attorney, Agent, or Firm*—Robert Groover; Betty Formby

[57] ABSTRACT

An auditing system for vending machines, preferably parking meters, that facilitates external exchange of digital information. The instant auditing system provides for electronic interrogation of the parking meter circuitry from portable, hand-held apparatus. The auditor is capable of processing and storing data derived from parking meters. In one form of the invention, communication is derived through the meter debit card payment slot. In an alternative embodiment data is optically exchanged and communicated between the auditor and the parking meter through infrared light. The auditor of the present invention can be interfaced with a personal computer through a standard RS232 serial port and appropriate interfacing software.

21 Claims, 8 Drawing Sheets

PAYMENT SLOT COMMUNICATING APPARATUS FOR VENDNG PRICES

BACKGROUND OF THE INVENTION

This invention relates generally to digital auditing or communicating systems for electronic vending devices. More particularly, the present invention relates to solid state systems for conveniently electronically communicating with the digital circuitry within modern parking meters and vending machines, and for interrogating and extracting information from the meters.

The variety of electronic and mechanical parking meters are well-known in the prior art. Typical parking meters receive one or more coins to begin a timing interval during which a vehicle may remain parked in an appropriate space associated with and adjacent to the parking meter. The timing interval, or the amount of time vended by the meter to the user, is typically determined by the number and value of the coins which are inserted into the parking meter. Recently, electronic parking meters have evolved for digitally electronically vending time. Although such electronic parking meters often have mechanical parts, the primary thrust of modern parking meter technology is directed to solid state circuitry and apparatus for parking meters which minimizes downtime, reduces mechanical unreliability, and provides an electronic means of accounting. As electronic parking meters evolve, and more and more computer circuitry is contemplated, the accounting possibilities presented by meters increases.

With older, strictly mechanical parking meters, the meter reader must walk to each meter and manually empty the coins and tally them to determine meter activity. With electronic parking meters, this is substantially avoided. For example, accumulated parking time and accumulated sales may be stored within electronic memory. Moreover, "busy" times of the day may be computed. Electronic programming responsible for such meters allows the user to easily vary parking rates or change them when desired.

Another advantage of modern electronic computerized parking meters is that they may be triggered externally without the use of coins. Accordingly, payment slots may be included for the use of debit cards which are incremented by the circuitry. Prepaid parking "time" represented by magnetic information on the cards may be used to vend time. As an example, attention is directed to U.S. Pat. No. 4,880,097, owned by the same assignee as in this case. When such a "debit" card (i.e. normally the size of a plastic credit card) is used to purchase time, it need be simply inserted into the parking slot or the coin slot. Alternatively, the parking card and coins may be inserted into separate slots. A purchaser may vary the amount of time purchased on the meter, either by using his debit card or by inserting required coins.

A further advantage of the electronic meters is that fewer coins need be collected and handled, since much of the meter time is purchased by the park card. The meter then electronically stores in its memory the meter activity thereby reducing the number of coins in the meter.

Advanced electronic meters of the type described in the '097 patent further provide an auditor. The auditor is typically used to program the parking meter and/or to extract data from the parking meter, such as the activity of the meter, etc. Also, the auditor can be used to program and gather data from the parking meter by connecting the auditor directly. In the past, direct connect auditors have required a separate slot or access port through the housing wall. Such an extra slot, in addition to the slot for a coin or a card, increases the environmental problems involved with meters in an outdoor setting. The more slots a meter has, the more likely that environmental elements such as rain, snow, sleet and dirt particles could enter the meter, thereby causing problems in the operation thereof. In general, outdoor vending devices such as meters must be capable of withstanding the elements. To lessen the likelihood of failures, the meters must be relatively well-protected from weather conditions. To this end, the fewer holes that allow foreign particles to enter the meter the better.

In addition, an auditor could be used to program and gather data from a parking meter or other vending device by interfacing the auditor to the parking meter through an infrared-red transmission system. Such an infrared-red system was used to avoid having an extra slot as to avoid the problem as discussed above, among other reasons. However, the infrared systems are not the fastest systems available for data acquisition and also require fairly accurate aiming of the auditor toward the vending device during the entire auditing process.

SUMMARY OF THE INVENTION

The present invention provides a parking meter apparatus that may be externally accessed for electronic interrogation. The invention provides for auditor apparatus having means for processing and storing data and means for communicating between the latter and the parking meter. Communication is established through either a payment slot or a coin input slot formed in the housing.

Preferably, data is communicated between the auditor and the parking meter through either infrared light or through direct card contact. The preferred auditor is portable, and may be hand held. It electrically connects with a probe-like wand adapted to be inserted into the meter through the coin slot or the debit card slot. The auditor of the present invention can be interfaced with a personal computer through a standard RS232 serial port and appropriate interfacing software. Vend information and parameters including rate changes, battery charge data, audit records, accumulated sales, meter "i.d." numbers, the date and the time, etc. can be extracted from parking meter memory. In addition, various parameters can be programmed into parking meter memory so that critical parameters may be modified. The communicator also acts as a temporary device for transporting data to and from the parking meters to a remote personal computer for processing.

Thus, a fundamental object of the invention is to provide portable, electronic system for communicating with electronic parking meters.

It is also a basic object of the invention to provide a hand-held communicating device which may be used to interrogate the electronic memory of vending machines.

A general object is to simplify parking meter maintenance, and to ease auditing burdens.

A further object is to provide a system of the character described that can reprogram and audit vending devices such as parking meters and the like.

Another important object is to enable the convenient, field auditing of parking meters or vending machines.

A similar important object is to provide a convenient means of auditing parking meters or vending machines that does not require mechanical disassembly.

Yet another object of the invention is to provide an electronic auditing system for parking meters that be inserted through preexisting slots in parking meter cases to access machine memory.

Specifically, it is an object to provide a computerized, portable interrogating device which can be conveniently used to audit, monitor and reprogram parking meters if necessary.

Another object is to enable optical communication with a parking meter.

A further object is to provide a completely portable, hand held system for auditing vending machines such as parking meters.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The apparatus to be hereinafter described is most advantageously employed in conjunction with parking meters. However, the teachings of the present invention relate to vending machines in general, and particularly to those vending machines which include electronic circuitry for monitoring vends, sales, time increments, accumulated sales, and the like. Further, the present invention is generally related to all vending devices that have a payment slot for receiving coins and/or a card for initiating a vend.

A variety of parking meters may be employed with the invention. However, the invention is ideally adapted for modern electronic parking meters, such as the meter of U.S. Pat. No. 4,823,928 owned by the same assignee as in this case. For disclosure purposes, the latter reference is incorporated by reference herein.

A typical parking meter upon which the present system may be employed may have a vending slot and/or a coin slot for acceptance of payment. As described in detail, for example, in U.S. Pat. No. 4,823,928, coins inputted to the coin chute ultimately trigger the meter circuitry to initiate a vend. The parking meter circuitry of the latter patent assumes a "sleep mode" to prevent discharge of the battery during periods of inactivity. Ideally the present communicating apparatus should coexist with such circuitry, but it will be apparent to those skilled in the art that it can be adapted for parking meters and vending machines that do not include the "sleep mode" particularities of the aforementioned P.O.M. patents or the particular mechanical structure of the coin drop apparatus described therein.

With initial reference to FIGS. 1–4, the communication apparatus 10 thereshown mechanically engages with the parking meter through the debit card slot. The alternative embodiment to be hereafter described establishes communication through the coin drop slot.

Figure 1:
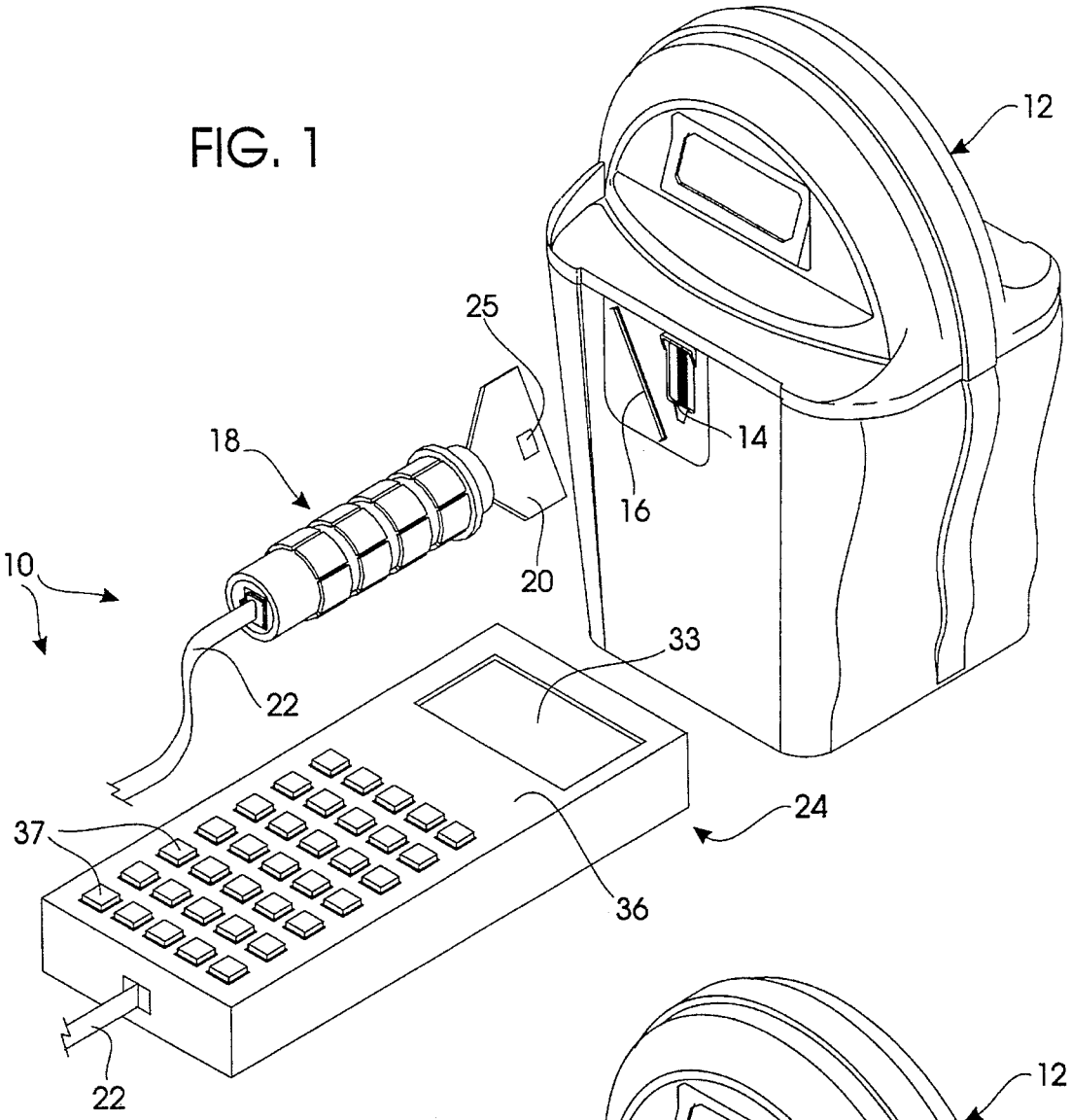
FIG. 1 is a fragmentary, isometric view illustrating a preferred embodiment of the invention, wherein the communicator wand includes a modified parking debit card for communication with the parking meter through the card slot.
Figure 2:
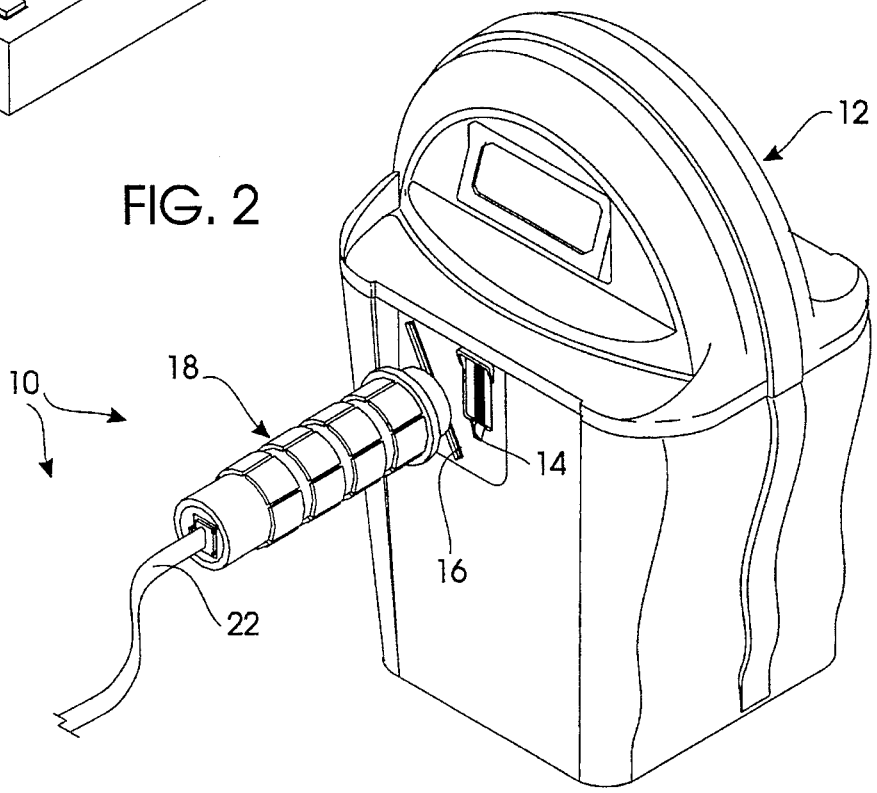
FIG. 2 is a fragmentary, isometric view similar to FIG. 1, but showing the wand inserted into the payment slot.

As seen in FIGS. 1–2, a typical parking meter 12 includes a coin payment slot 14 spaced apart from an angled debit card slot 16. System 10 comprises an external wand, generally indicated by the reference 18, including a forward projecting, modified debit card portion 20 adapted to be inserted through slot 16. The wand 18 communicates through a line 22 to an external electronic sensing apparatus or auditor 24. Card 20 comprises electrical contacts 25 and internal micro-circuitry. Debit cards for payment slot electronic auditing are available from Innovatron Company, 137 Boulevard de Sebastopol, 75002 Paris FRANCE.

As hereinafter described, such debit cards may be received through the slot and mechanically guided and electronically interrogated through a variety of known techniques. For example, card receptor mechanisms for receiving debit cards and communicating with their integrated circuit and logic is seen in one or more of the following Alcatel patents, issued to Alcatel CIT, Paris, France: 4,900,272, 4,900,273, 5,012,078, 5,051,566, The device 10, including wand 18 and auditor 24 may be manually moved about and used to interrogate, service, or inspect vending devices. As seen in FIG. 2, the wand has been inserted through the debit slot 16 and guided therewithin through mechanical structure similar to that seen in the aforementioned Alcatel patents. When this occurs accumulated digital information relating to sales, vends and the like is extracted through the wand and analyzed in the auditor 24. When wand 18 is fully inserted into slot 16, contacts 25 will be forced into engagement with suitable receptors to make electrical contact. When the wand is fully inserted as in FIG. 2, the information and the memory therein can be interrogated, as will be described in conjunction with a description of detailed circuits later.

The auditor 24 is a hand-held computer-like device which may be quick coupled to the cord 22. It comprises a visual display 33 mounted to its plastic case 36 and plurality of control buttons 37. A variety of different devices could be substituted for auditor 24, including personal computers and the like. Ultimately electrical interconnection will be established between the contacts 25 on the wand card portion 20 and electrical circuitry within the auditor 24.

Figure 3:
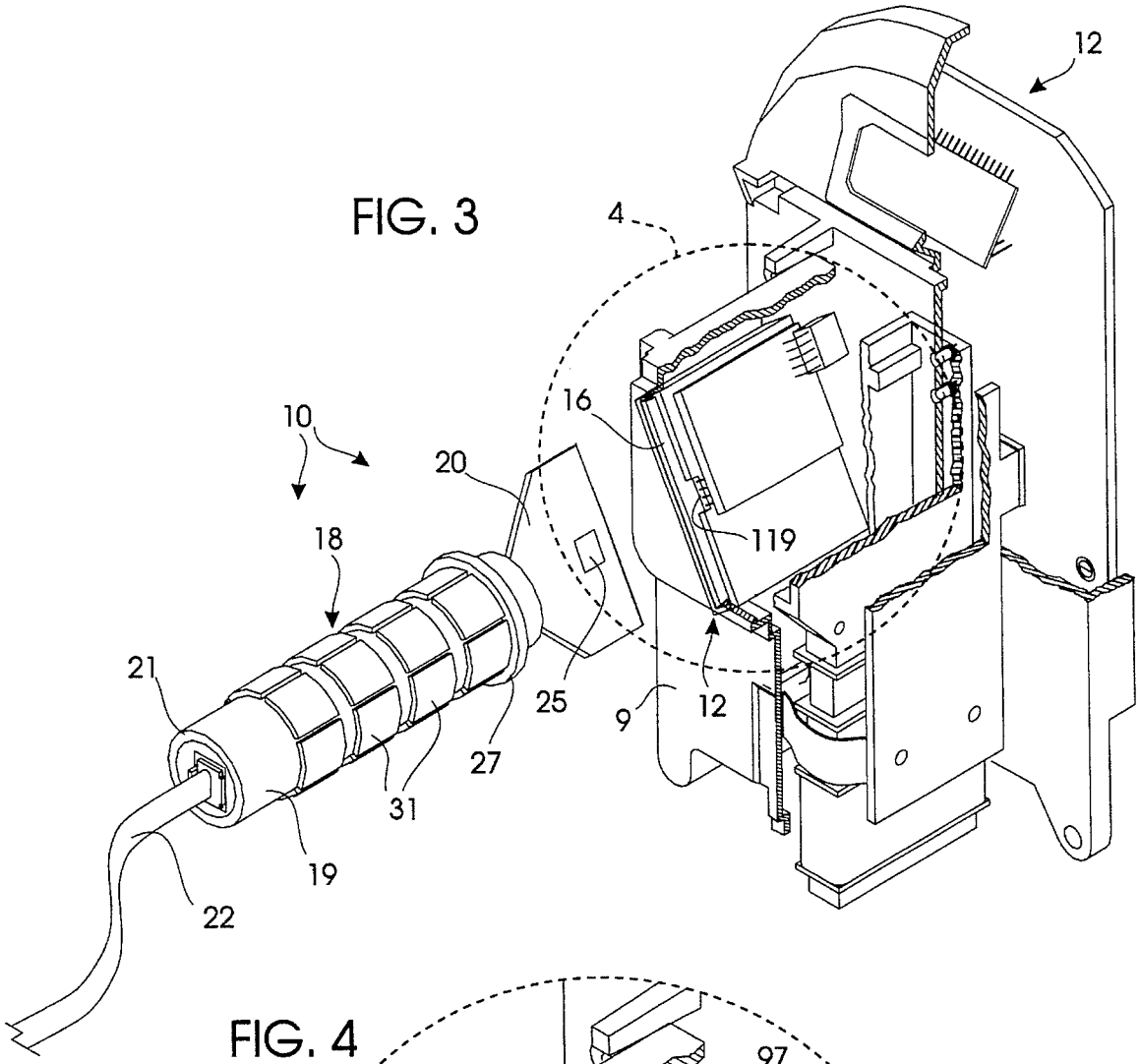
FIG. 3 is an enlarged, fragmentary view of the wand and apparatus of FIG. 1, showing how the card end is inserted into the debit card slot.
Figure 4:
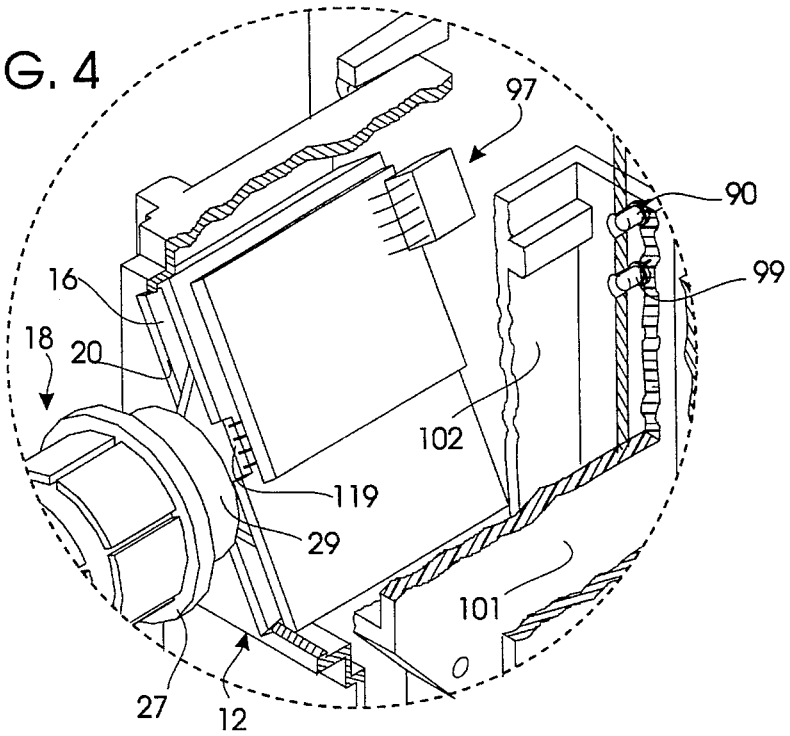
FIG. 4 is an enlarged, fragmentary isometric view showing the circled portion of FIG. 3 identified with the reference number 4.
Figure 5:
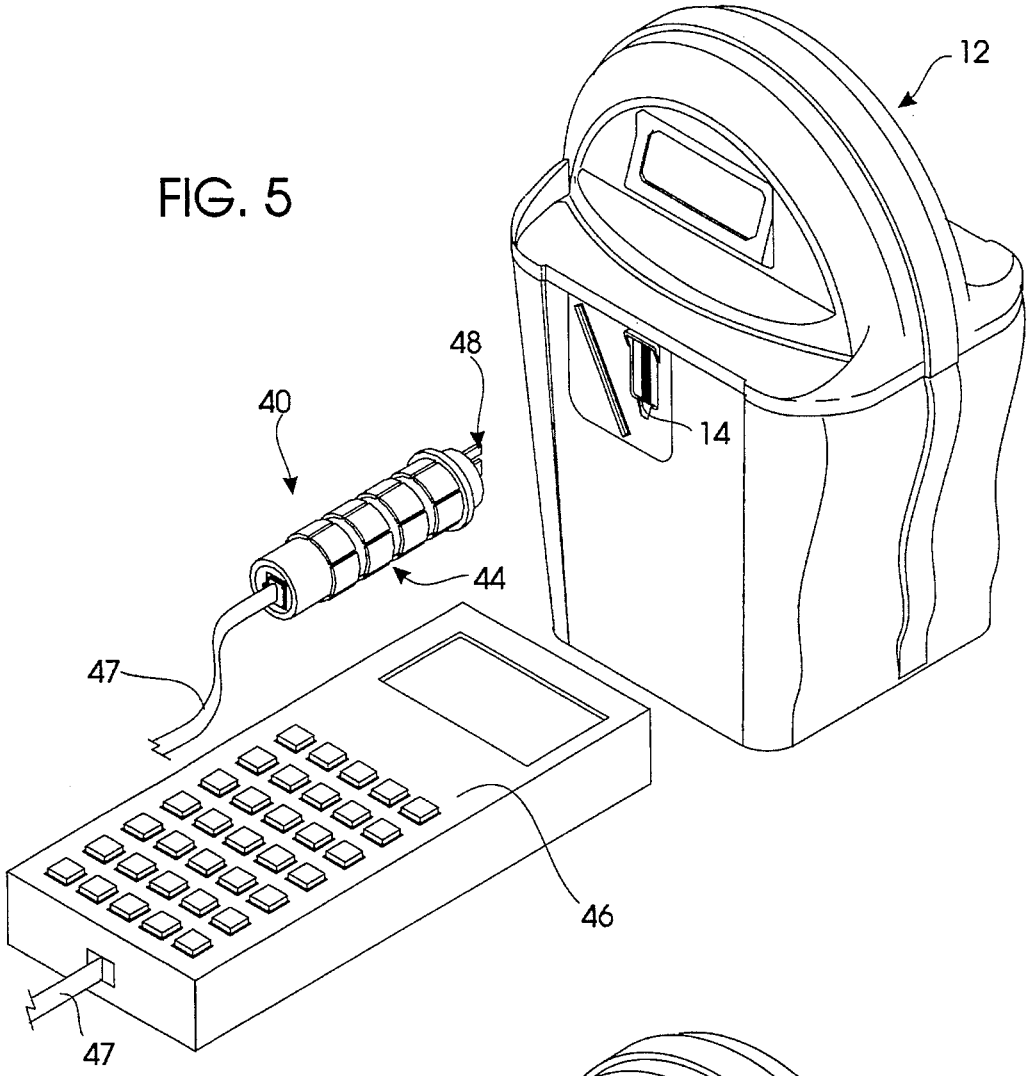
FIG. 5 is a fragmentary, isometric view of an alternative embodiment, wherein the communication wand penetrates the parking meter coin slot.

Turning now to FIGS. 3 and 4, wand 18 preferably comprises a resilient, generally cylindrical body 19 having a rear end 21 adapted to be coupled to line 22. The front end of the wand includes a circumscribing flange 27 spaced from a projection 29 that frictionally engages card 20. When the card 20 enters the debit card slot 16, it will wake the meter from the "sleep mode." The meter will quickly "wake-up," energize its circuitry, and initiate communication through the electrical contacts 25. Preferably, a plurality of tactile pads 31 are defined on the outer cylindrical surface to aid in manually positioning the device.

The forwardly projecting card portion 20 comprises an array of electrical contacts 25 for mechanically and electrically engaging suitable receptors 119 disposed within the slot 16 of the debit card system. ISO-7816-2 standards are employed. As explained previously, the debit slot card reading apparatus is available through Alcatel in Paris, France, and covered through one or more of their previously described patents. By directing the card portion 20 through the debit card slot 16, an electrical connection between contacts 25 and receptors 119 is established, whereupon the circuitry may be interrogated. An adjacent compartment 97 adjacent the coin slot is internally defined between opaque plastic walls 101 and 102 (FIG. 4) that block infrared, transparent ambient light from entering the apparatus. The modified housing 96 may be provided with an optical sensor 90 and an LED 99 described hereinafter, so that the marking meter illustrated will be compatible with either direct card contacting as aforedescribed, or infrared communication as hereinafter described.

Turning now to FIGS. 5–8, an alternative sensing apparatus 40 comprises a short-range infrared communicating wand 44 coupled to a similar auditor 46 through a detachable cable 47. Wand 44 is similar to wand 18 previously discussed. Preferably it comprises a generally cylindrical, floating head 41 having forward projecting prongs 48 adapted to engage the payment coin slot 14 of the parking meter 12. Wand 44 preferably comprises a generally cylindrical, elongated housing 50 that terminates in a receptacle for receiving jack 52 that is coupled to electrical cord 47. Outer tactile pads 58 and 59 defined on the outer cylindrical surface to aid in handling. The wand terminates forwardly in a surrounding lip 60 that circumscribes head 41. Housing 50 comprises a hollow, internal compartment 53 for mounting its internal circuit board 107.

Figure 6:
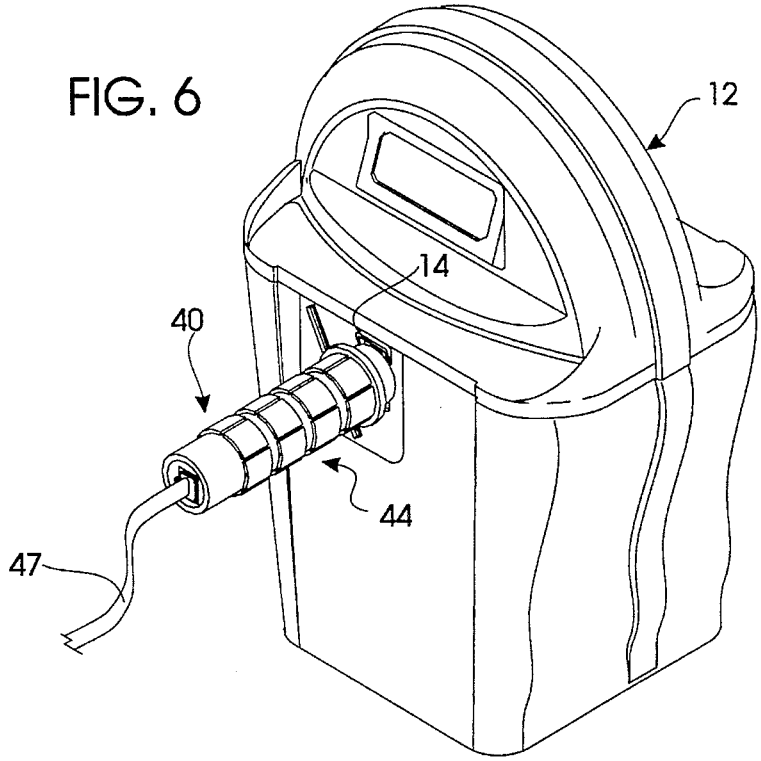
FIG. 6 is a fragmentary, isometric view similar to FIG. 3, but showing the wand fully inserted within the coin slot.
Figure 7:
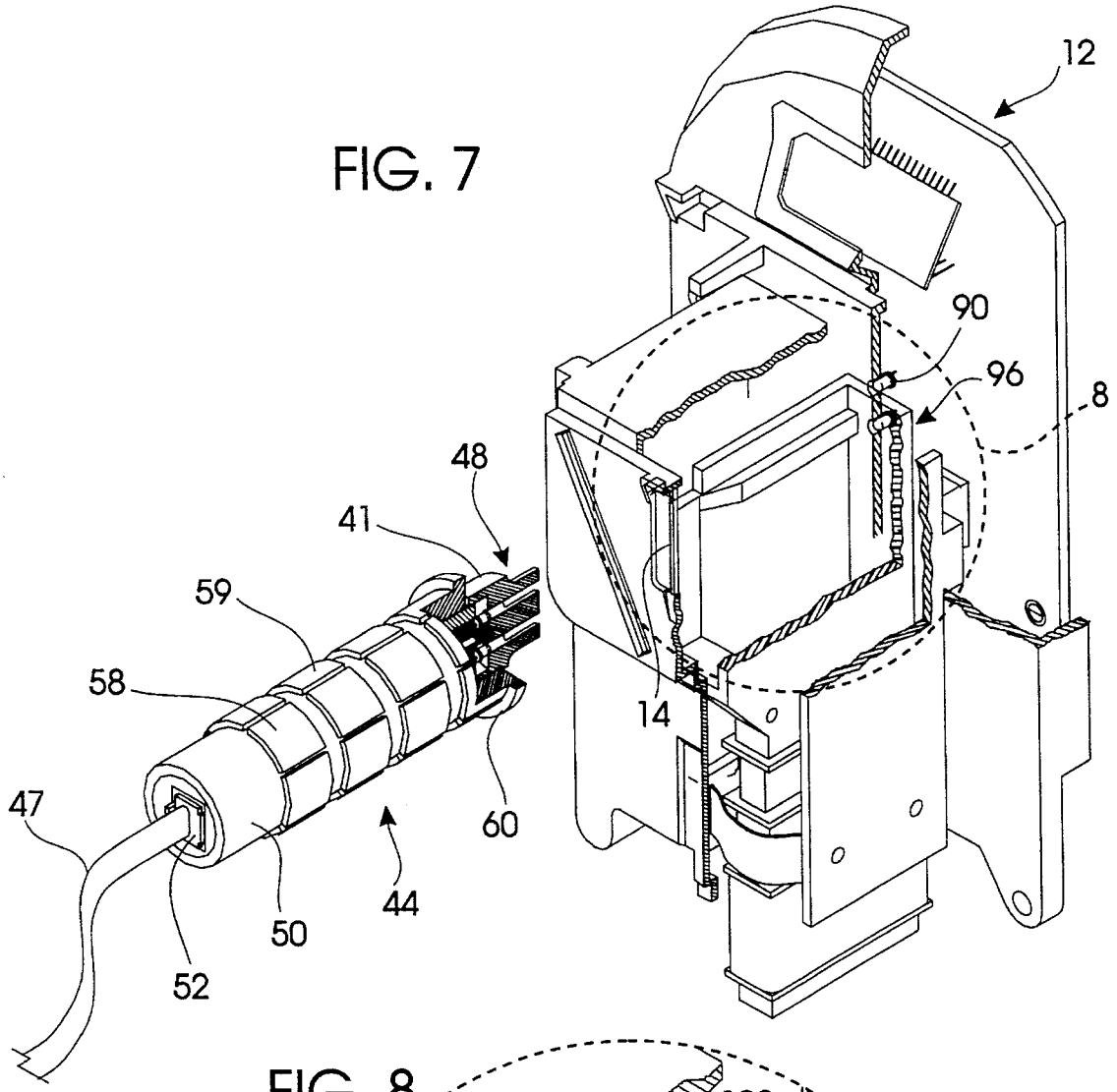
FIG. 7 is an enlarged, fragmentary isometric view showing the wand of FIGS. 5 and 6 that engages the coin slot, and showing the internal parking meter housing that receives it.

When the wand 40 is fully inserted as in FIG. 6, if there is a "sleep mode" associated with a parking meter circuitry, the parking meter will "wake-up," energize its circuitry, and initiate communication through the wand 40 with the auditor 46. For this purpose, infrared communication, as described hereinafter, is preferably employed.

Figure 8:
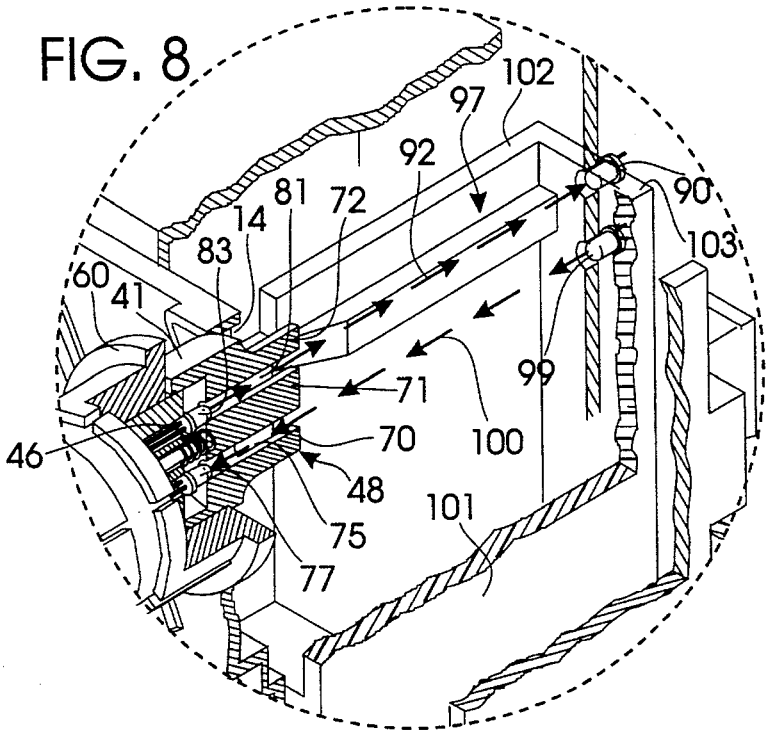
FIG. 8 is an enlarged, fragmentary isometric view taken generally from a circled region identified with the reference numeral 8 in FIG. 7.
Figure 9:
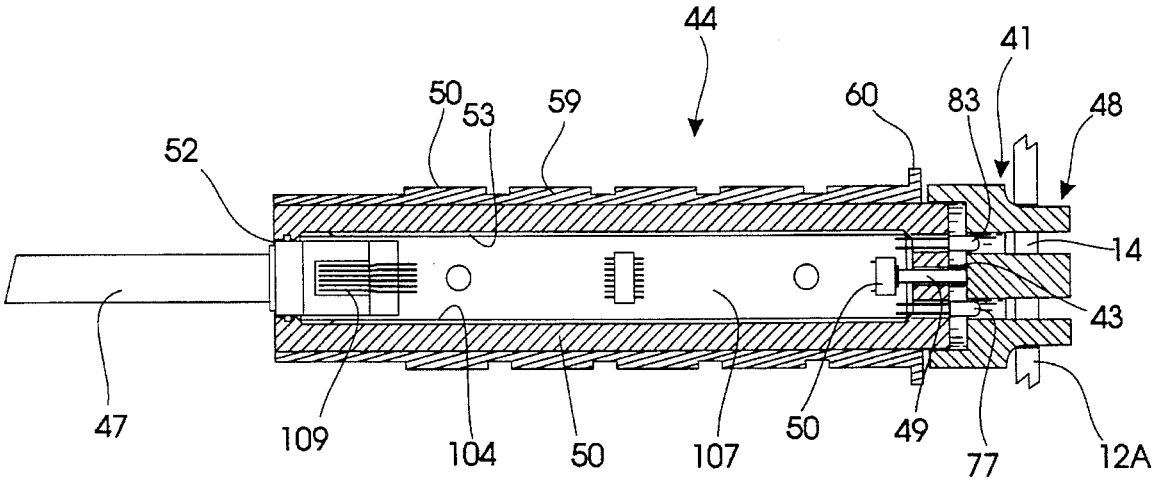
FIG. 9 is an enlarged, longitudinal sectional view of the wand of FIGS. 5–8, with portions thereof broken away or shown in section for clarity.

When prongs 48 are pushed through the coin slot 14, they will be aligned within the meter as in FIG. 8. Head 41 will be displaced inwardly of the wand, against yieldable bias from a spring 43. As best seen in FIG. 8, prongs 48 comprise a plurality of spaced apart projecting, resilient elements, 70, 71 and 72. The center prong 71 contacts spring 43, which normally urges head 41 outwardly from housing 50. When head 41 is displaced towards the left by mechanical contact with the meter face, a shaft 49 (FIG. 9) is displaced, activating a switch 51 that in turn activates the wand circuitry.

A passageway 75 defined between elements 70 and 71 transmits light towards a phototransistor 77 projecting from the end of the wand housing 50. A similar passageway 81 is defined between elements 71 and 72. An LED 83 projects modulated infrared light through passageway 81 towards an infrared sensor 90 disposed within the parking meter internal housing 96 to be hereinafter described. As indicated by arrows 92, light travels to the right (i.e., as viewed in FIG. 8) and activates infrared sensor 90 when information is transmitted to the modified parking meter circuitry. An infrared transmitter 99 disposed within the modified circuitry transmits light generally to the left (i.e., as viewed in FIG. 8), as indicated by arrows 100. In this way, information from the circuitry within the modified parking meter is exchanged between the wand and the analyzer 46.

Figure 10:
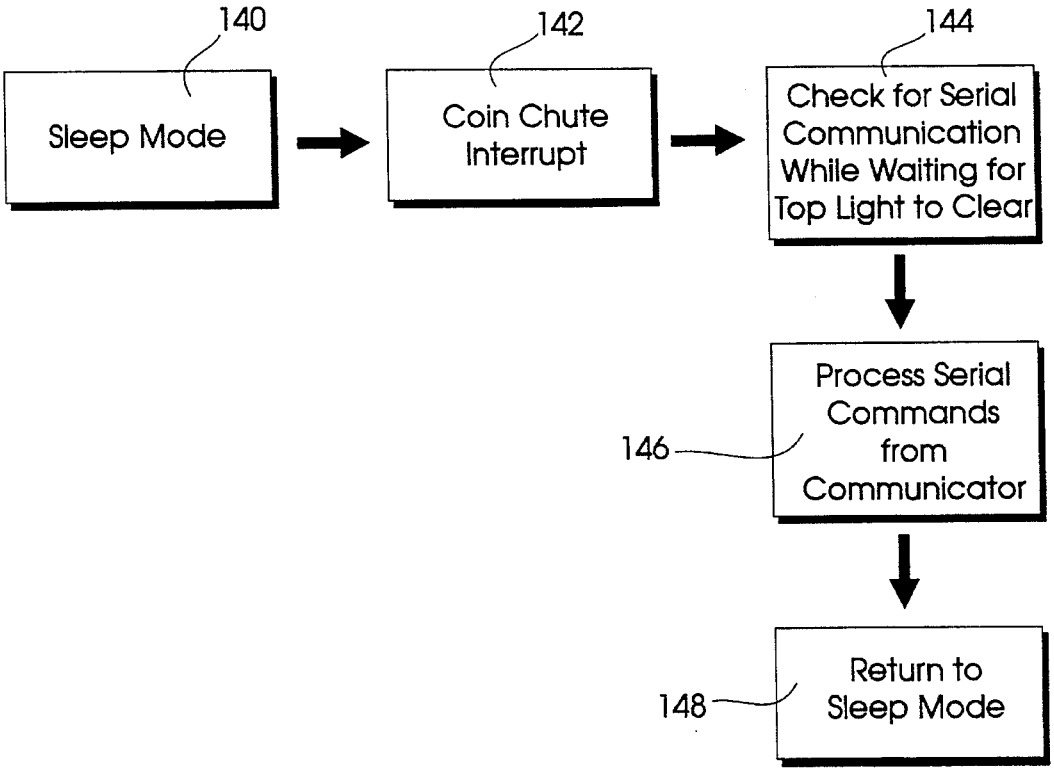
FIG. 10 is a block diagram of the preferred logic employed of the apparatus of FIGS. 1 through 9.

Referring now to FIG. 10, the parking meter 12 will initially be in the sleep mode, indicated by the reference numeral 140. When the wand 44 is inserted through the coin receptor slot, the coin chute interrupt step 142 occurs, so that the parking meter wakes-up. Serial Information is transmitted optically from the wand through the slot 81 to sensor 90 (FIG. 8), and serial information is received by wand phototransistor 77 in step 144. Serial commands are processed in step 146, and after the wand is withdrawn, the parking meter returns to the sleep mode, as indicated in step 148.

Figure 11:
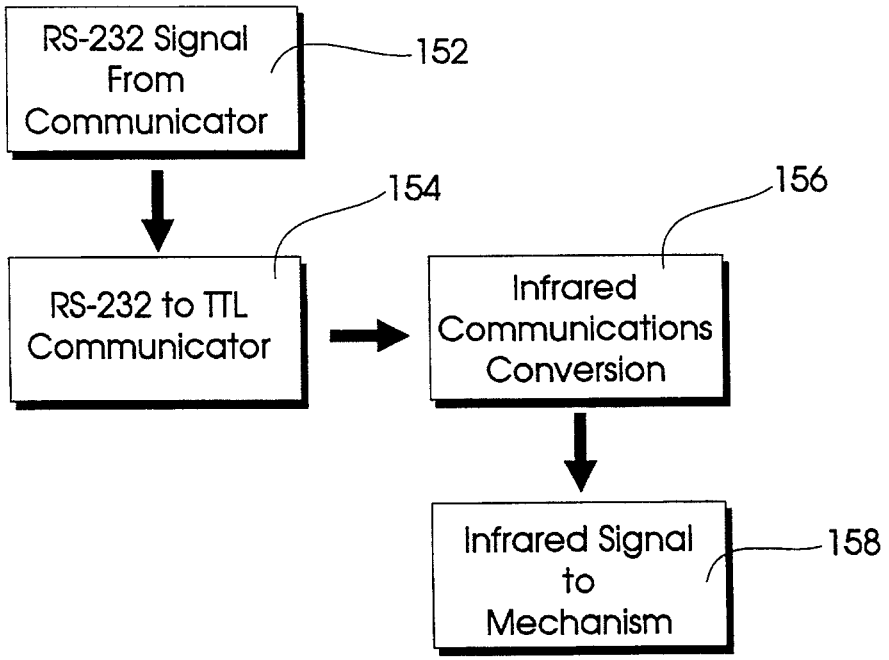
FIG. 11 is block diagram of the transmission steps for inputting information from the wand to the parking meter.

With reference to FIG. 11, auditor 46 generates RS232 serial signals, as indicated by step 152. These signals are converted to TTL standards in step 154, so that the LED can be easily modulated, as in step 156. The infrared light signal is transmitted to the internal mechanism (i.e., the optical sensor 90 in FIG. 8) through step 158.

Figure 12:
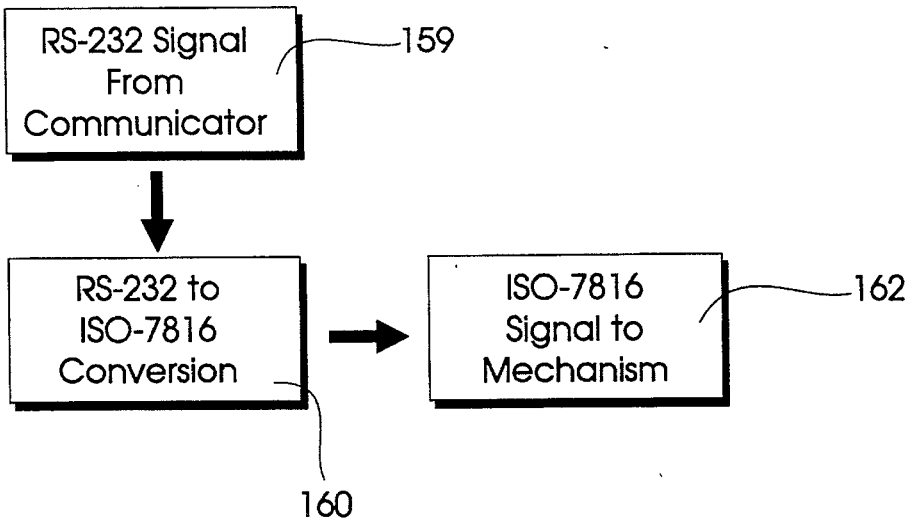
FIG. 12 is a block diagram of the reception steps for receiving information from the wand of FIGS. 1 and 2.

FIG. 12 shows an alternative approach, wherein the RS232 signal is received in step 159 and converted to ISO-7816 standards in step 160. In step 162, the infrared transmission is made to the meter mechanism.

Figure 13:
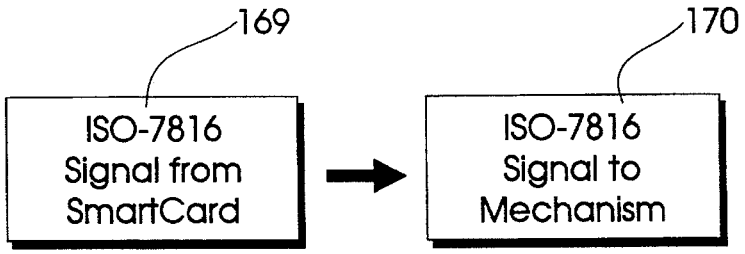
FIG. 13 is a block diagram of the reception step for receiving the information through a card.
Figure 14:
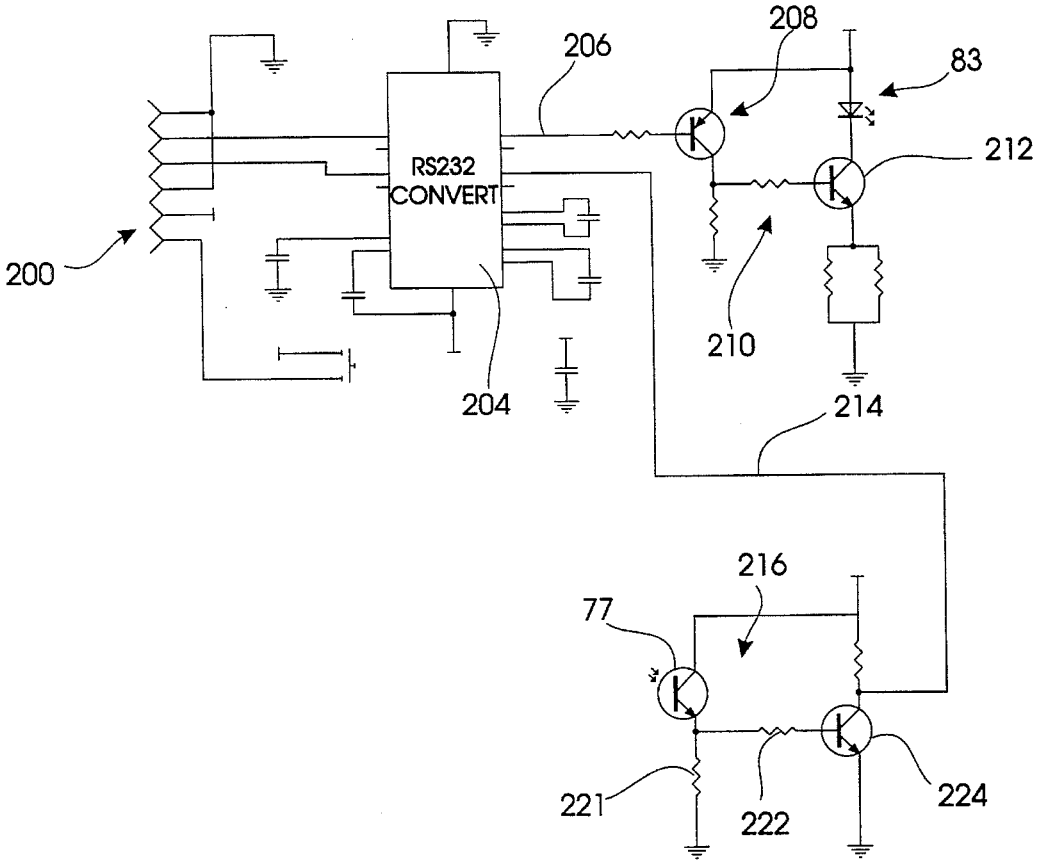
FIG. 14 is an electronic schematic diagram of the memory access connection contained in the wand.

FIG. 13 indicates that with the embodiment of FIGS. 1–4, an ISO-7816 signal in step 169 is directly transmitted to the mechanism through the wands in step 170. With concurrent reference now to FIGS. 11 and 14, an RS232 signal from the auditor is inputted on lines 200. These lines comprise the familiar ground, transmit and receive lines of the RS232 standard. Binary information is transmitted to RS232 convertor 204 which has an output line 206 leading to driving transistor 208. Convertor 204 is a MAX222 chip manufactured by MAXIM for RS232 communications. Switch 210 is a direct drive switch that operates in conjunction with output transistor 212. LED 83 in the collector circuit of transistor 212 is appropriately modulated through switch 210.

Conversion circuit 204 comprises a line 214 driven by sensing circuit 216. An optical phototransistor 77 is emitter-coupled through resistors 221 and 222 to a driver transistor 224, the collector output of which is delivered via line 214 to drive convertor 204. Return information is thus sensed during the short-range infrared receiving cycle of the wand apparatus.

Figure 15:
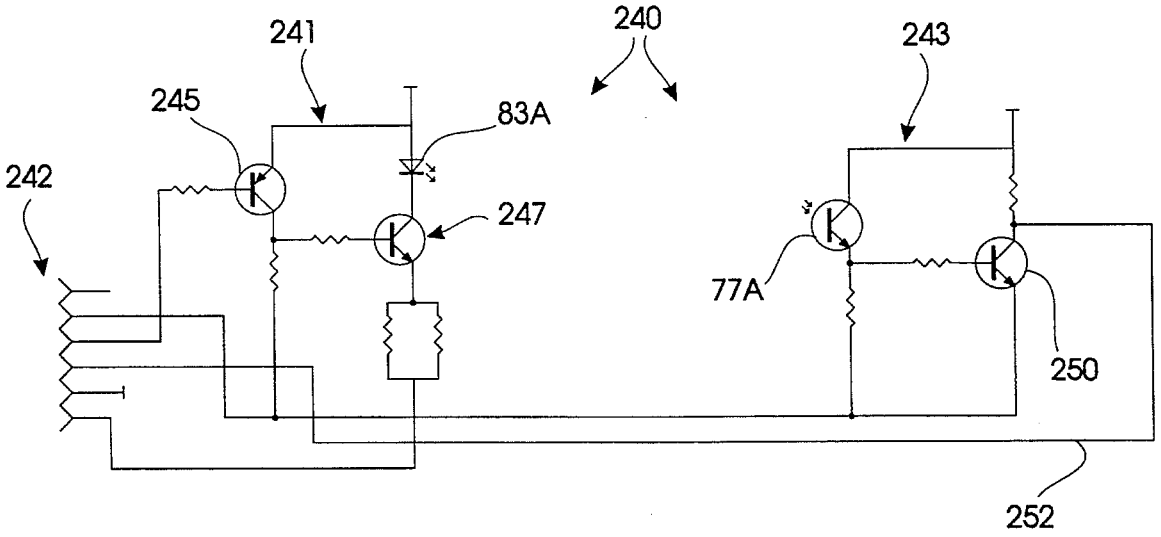
FIG. 15 is a schematic diagram showing an alternative short-range infrared communication system used by the parking meter for coin payment slot communication; and, FIG. 16 is an electronic schematic diagram of the modified parking meter circuitry for communicating with the apparatus of FIGS. 1 through 8.

In FIG. 15 an alternative short-range circuit 240 comprises a short-range infrared transmitter 83A and a short-range phototransistor 77A. Transmitter 241 receives TTL serial signals along lines 242 at 1024 baud. A driver transistor 245 is emitter coupled to driver transistor 247 for activating infrared transmitter 83A. Short-range receiver 243 comprises a driver transistor 250 emitter coupled to phototransistor 77A that outputs on line 252 back to terminals 242.

Figure 16:
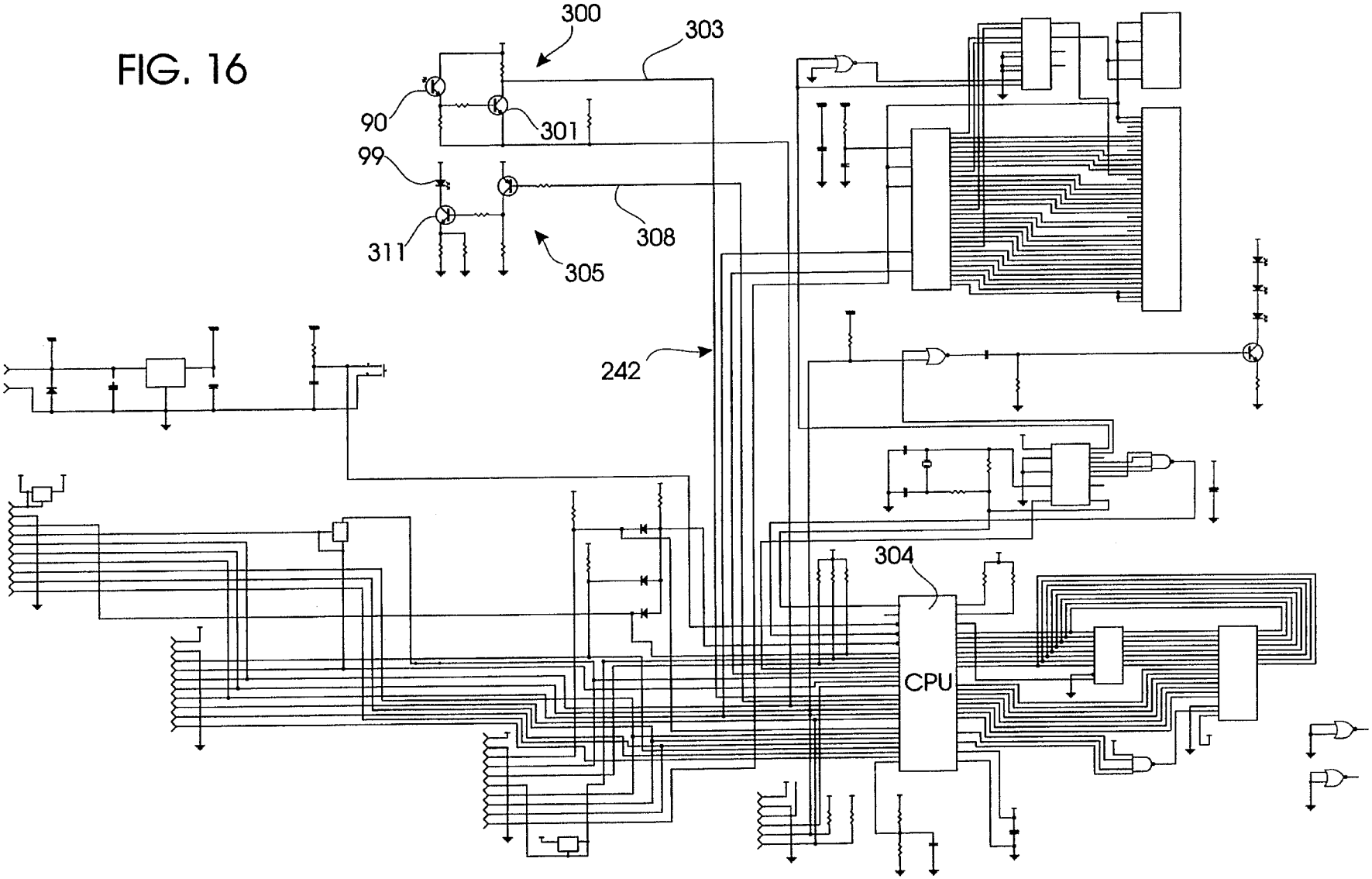

Turning now to FIG. 16, the parking meter circuitry described in the aforementioned P.O.M. patent may be modified to incorporate the optical sensor 90 (FIG. 6) and the light-emitting diode 99. A receiving circuit has been generally designated by the reference number 300. The optical sensor 90 activates driver transistor 301 whose collector output is transmitted to a line 303 leading to the CPU. The LED 99 is activated by transistor circuit 305. A line 308 from the CPU of 304 activates transistor 309 that drives transistor 311 to activate LED 99.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An auditor apparatus for use with a vending device having a payment slot, the apparatus comprising:

means for reading digital data concerning activity of said vending device; and, means for communicating between said means for reading data and the vending device, said means for communicating comprising sensing means for insertion into the payment device receiving slot in the vending device.

2. The auditor as defined in claim 1 wherein said means for communicating comprises a portable auditor and a wand adapted to engage the vending device.

3. The auditor as defined in claim 2 wherein said wand comprises a card provided with electrical contacts for engaging the payment slot.

4. The auditor as defined in claim 2 wherein said wand comprises means for optically communicating with the vending device.

5. The auditor as defined in claim 4 wherein said means for optically communicating with the vending device comprises an LED for transmitting information to the meter and a sensor for receiving information optically transmitted by the meter.

6. An auditor apparatus for use with a parking meter comprising an internal circuit and a card receiving slot for accepting payment, said apparatus comprising:

means for exchanging digital data concerning activity of said parking meter; and, a means for communicating between said means for exchanging data and the parking meter, said means for communicating comprising card means for insertion into the card payment receiving slot, said card means comprising means for establishing electrical contact with the meter circuit.

7. The auditor as defined in claim 6 wherein said means for communicating comprises a portable auditor and a wand adapted to engage the parking meter.

8. The auditor as defined in claim 7 wherein said card means projects from said wand.

9. An auditor apparatus for use with a parking meter comprising an internal circuit and a coin receiving slot for accepting payment; said apparatus comprising:

means for exchanging digital data concerning activity of said parking meter; and, means for communicating between said means for exchanging data and the vending device, said means for communicating comprising card means for insertion into the card payment receiving slot in the vending device, said card means comprising means for establishing electrical contact with the meter circuit.

10. The auditor as defined in claim 9 wherein said means for communicating comprises a portable auditor and a wand adapted to engage the parking meter.

11. An auditor for use with a parking meter having a payment slot, said auditor comprising:

a hand-held computer for collecting information from said parking meter concerning activity of said parking meter;

electrical contacts, electrically connected to said hand-held computer, through which information may be sent and received;

wherein said electrical contacts may be inserted into said payment slot in such a manner-that said hand-held computer may communicate with said parking meter through said electrical contacts.

12. The auditor of claim 11, wherein said electrical contacts are located on a wand which can be inserted into said payment slot.

13. The auditor of claim 11, wherein said payment slot comprises a slot for accepting smart cards.

14. An auditor for use with a parking meter having a payment slot, said auditor comprising:

a hand-held computer for collecting information from said parking meter concerning activity of said parking meter;

an optical communication device, electrically connected to said hand-held computer, through which information may be sent and received;

wherein said optical communication device may be inserted into said payment slot in such a manner that said hand-held computer may communicate with said parking meter through said optical communication device.

15. The auditor of claim 14, wherein said optical communication device comprises a wand having a short-range infrared transmitter and a short-range phototransistor.

16. The auditor integrated circuit of claim 14, wherein said payment slot is for the receipt of coins.

17. A method of communicating with a parking meter concerning activity of said parking meter, comprising inserting in auditor into a payment slot in the parking meter and transmitting information to and receiving information from said parking meter through said communication device.

18. The method of claim 17, wherein said payment slot is for the receipt of coins.

19. The method of claim 17, wherein said payment slot is for the receipt of a smart card.

20. The method of claim 17, wherein said auditor comprises electrical contacts for the transfer of information.

21. The method of claim 17, wherein said auditor comprises a wand having a short-range infrared transmitter and a short-range phototransistor.

* * * * *